US006291154B1

(12) United States Patent
Adin et al.

(10) Patent No.: US 6,291,154 B1
(45) **Date of Patent: *Sep. 18, 2001**

(54) GREEN SENSITIZED TABULAR GRAIN PHOTOGRAPHIC EMULSIONS

(75) Inventors: Anthony Adin; Frederick Charles Derks, both of Rochester; Melvin Michael Kestner, Hilton; Steven George Link, Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/010,912

(22) Filed: Jan. 29, 1993

(51) Int. Cl.[7] ..... G03C 1/00; G03C 1/18

(52) U.S. Cl. ..... 430/574; 430/567; 430/569; 430/583; 430/585

(58) Field of Search ..... 430/583, 567, 430/569, 574, 585

(56) References Cited

U.S. PATENT DOCUMENTS

| | | | |
|---|---|---|---|
| H583 | 2/1989 | Asami | 430/550 |
| 3,864,134 | 2/1975 | Ueda et al. | 96/124 |
| 4,510,235 | 4/1985 | Ukai et al. | 430/574 |
| 4,544,628 | 10/1985 | Mihara et al. | 430/572 |
| 4,555,481 | 11/1985 | Ukai et al. | 430/550 |
| 4,594,317 | 6/1986 | Sasaki et al. | 430/574 |
| 4,607,005 | 8/1986 | Urata | 430/550 |
| 4,675,279 | 6/1987 | Shuto et al. | 430/567 |
| 4,701,405 | 10/1987 | Takiguchi et al. | 430/567 |
| 4,791,053 | 12/1988 | Ogawa | 430/581 |
| 4,814,264 | 3/1989 | Kishida et al. | 430/567 |
| 4,865,962 | 9/1989 | Hasebe et al. | 430/567 |
| 4,876,183 | 10/1989 | Miyasaka et al. | 430/567 |
| 4,888,272 | 12/1989 | Kishida et al. | 430/569 |
| 5,041,366 | 8/1991 | Asano et al. | 430/567 |
| 5,059,517 | 10/1991 | Ihama et al. | 430/567 |
| 5,064,753 | 11/1991 | Sohei et al. | 430/567 |
| 5,091,298 | 2/1992 | Parton et al. | 430/570 |

FOREIGN PATENT DOCUMENTS

| | | |
|---|---|---|
| 0 126 990 | 12/1984 | (EP) . |
| 0 112 162 | 4/1989 | (EP) . |
| 1 231 079 | 5/1971 | (GB) . |
| 2 176 304 | 12/1986 | (GB) . |

*Primary Examiner*—Thorl Chea
(74) *Attorney, Agent, or Firm*—Arthur E. Kluegel

(57) ABSTRACT

A silver halide photographic element, and a method of making such an element, comprising a tabular grain silver halide emulsion containing at least one green spectral sensitizing dye of formula I, and at least one green spectral sensitizing dye of formula II:

(I)

M+ wherein R1 and R2 may be the same or different and are selected from substituted or unsubstituted C1 or C2 alkyl, substituted or unsubstituted C1 or C2 alkoxy, halogen, substituted or unsubstituted amido, or carbamoyl or substituted or unsubstituted aryl, provided that R1 and R2 are not both aryl, and the benzo back rings may optionally be further substituted;

X3 is a substituted or unsubstituted C1 to C3 alkyl or alkenyl;

X1 and X2 are acid or acid salt substituted C1 to C6 alkyl or alkenyl which may be further substituted or unsubstituted;

M+ is a positive ion as required to balance the charge;

(II)

N+ where R3 and R4 may be the same or different and represent substituted or unsubstituted alkyl or alkenyl of 1 to 4 carbon atoms;

R5 and R6 may be the same or different and both represent strong electron withdrawing groups;

R8 and R9 are independently hydrogen, halogen, or a substituted or unsubstituted methyl or ethyl, or a strong electron withdrawing group;

X4 and X5 are substituted or unsubstituted C1 to C6 alkyl or alkenyl at least one of which has an acid or acid salt substituent;

N+ is a positive ion as needed to balance the charge.

25 Claims, No Drawings

GREEN SENSITIZED TABULAR GRAIN PHOTOGRAPHIC EMULSIONS

FIELD OF THE INVENTION

This invention relates to a silver halide photographic element. Particularly, the present invention relates to a silver halide photographic element having a tabular grain emulsion containing a specific combination of green sensitizing dyes.

BACKGROUND OF THE INVENTION

Silver halide photographic elements contain silver halide crystals as a light sensitive substance. Silver halide crystals have a native sensitivity only to blue light. To make the crystals sensitive to other wavelengths of light, they are typically dyed with a spectral sensitizing dye or combinations of such dyes, such as cyanine-type dyes. These dyes capture the light energy and transfer it to the silver halide, forming a latent image which can be amplified when the material is processed. Since the viewed image in the photographic material is provided by colored image dyes in color systems, and by silver in black-and-white systems, it is also important that the senitizing dyes be effectively removed during processing of the element. Retained sensitizing dyes lead to degraded colors and stains in white areas of photographic prints.

In recent years advances in photographic efficiency have been realized through the use of so-called tabular grains. The thin flat geometry of these grains allows more crystals to be coated for the same mass of silver. This advantage can be used to reduce the total amount of silver, for example; or to reduce the graininess of photographs produced from photographic elements that contain these grains. Another advantage of tabular grains is the increased surface area per mass of silver. This allows the adsorption of larger quantities of spectral sensitizing dyes per mass of silver. In this way more light of wavelengths beyond the native sensitivity of the silver halide can be absorbed, further increasing the sensitivity of the silver halide to green, red, and infrared light.

However, the use of tabular grain emulsions in photographic elements is not without difficulty. In particular, it has been found that chemical sensitization (the addition of impurities such as sulfur and gold to the silver halide crystals to enhance their native or intrinsic response to blue light) is more difficult to control than with other grain types, such that higher photographic sensitivity is difficult to achieve. This problem has frequently been overcome by using a technique known as dye-in-the-finish. In this technique, the spectral sensitizing dyes are added in some fashion to the silver halide grains prior to the addition of the chemical sensitizers. In this way the dyes help to control the "finishing" of the grains and an improved response is achieved. Such technique is described in paragraph IIIB of *Research Disclosure I* (referenced later in this application).

Practically, it is not sufficient to simply achieve a higher sensitivity to light. Once the finished silver halide grains are incorporated into a photographic element, that element must have the proper speed, contrast, and fog for its intended application, and these properties must be stable during storage. Again because of the high surface area of tabular grains exposed to environmental factors such as oxygen and moisture, a stable finish with respect to speed and fog is sometimes difficult to achieve even with the dye-in-the-finish technique. This is particularly important with tabular emulsions which have been sensitized to green light, since most color photographic materials have red, green, and blue sensitive layers and many black-and-white materials are also sensitive to green light. For these reasons, there is still a need for improved dyes and combinations of dyes for spectrally sensitizing tabular emulsions to green light.

Also, recently, there has been a need to provide photographic materials that can be processed in shorter times using more concentrated processing solutions. This move to shorter process times has led to an increased problem with stain in processed photographic materials caused by the retention of sensitizing dyes. This can be of particular concern with tabular emulsions because of the increased amount of sensitizing dye per mass of silver as stated above. Higher levels of sensitizing dye combined with shorter processing times aggravate sensitizing dye stain to the extent that many dyes which efficiently act as spectral sensitizers can not be used practically. Therefore, there is even a greater need for spectral sensitizing dyes or combinations of dyes for tabular silver halide emulsions that provide optimum sensitivity to light, acceptable levels of fog, excellent stability during storage, and low levels of retained dye after processing.

The most commonly used class of spectral sensitizers for the green region of the spectrum is the oxacarbocyanine class of dyes. By themselves these dyes provide good sensitivity to light with wavelengths between 525 nm and 555 nm. Those dyes have also been used in combination with other dyes. For example, naphthoxazole carbocyanine dyes and benzimidazole carbocyanine dyes have been used in combination with oxacarbocyanine dyes. Also, UK 1,231,079, U.S. Pat. Nos. 4,544,628, 4,607,005, and 4,701,405 all describe the use of combinations of oxacarbocyanine dyes and benzimidazolocarbocyanine dyes. However, the foregoing references do not use such combinations on tabular grain emulsions or use combinations which do not provide good light senstivity, low fog levels, good storage stability and low retained dye levels following processing. (Also, EPA 126990 describes a particular type of benzimidazole dyes in combination for improved keeping).

It would therefore be desirable to provide photographic elements having tabular silver halide emulsions, with green sensitizing dyes which provide good sensitivity, low fog, good storage stability, and low levels of retained sensitizing dye, and which may be added to the emulsion prior to chemical sensitization.

SUMMARY OF THE INVENTION

Following much experimentation the present inventors have found that only certain very specific combinations of green sensitizing dyes can be used to sensitize tabular silver halide grain emulsions, while providing good sensitivity, low fog, good storage stability, and low levels of retained sensitizing dye, and which may be added to the emulsion prior to chemical sensitization.

The present invention therefore provides a tabular grain silver halide emulsion containing at least one green spectral sensitizing dye of formula I, and at least one green spectral sensitizing dye of formula II:

(I)

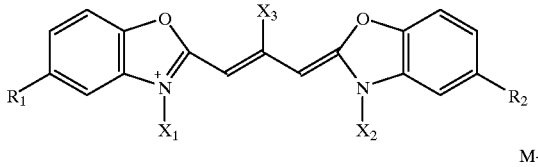

M+ wherein R1 and R2 may be the same or different and are selected from substituted or unsubstituted C1 or C2 alkyl, substituted or unsubstituted C1 or C2 alkoxy, halogen, substituted or unsubstituted amido or carbamoyl, or substituted or unsubstituted aryl, provided that R1 and R2 are not both aryl, and the benzo back rings may optionally be further substituted;

X3 is a substituted or unsubstituted C1 to C3 alkyl or alkenyl;

X1 and X2 are acid or acid salt substituted C1 to C6 alkyl or alkenyl which may be further substituted or unsubstituted;

M+ is a positive ion as required to balance the charge;

(II)

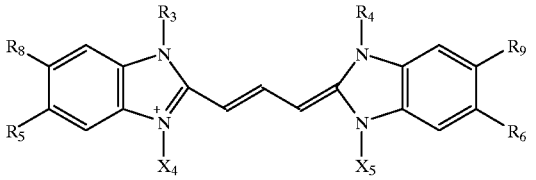

N+ where R3 and R4 may be the same or different and represent substituted or unsubstituted alkyl or alkenyl of 1 to 4 carbon atoms;

R5 and R6 may be the same or different and both represent strong electron withdrawing groups;

R8 and R9 are independently hydrogen, halogen, or a substituted or unsubstituted methyl or ethyl, or a strong electron withdrawing group;

X4 and X5 are substituted or unsubstituted C1 to C6 alkyl or alkenyl at least one of which has an acid or acid salt substituent;

N+ is a positive ion as needed to balance the charge.

The present invention further provides a method of making a photographic element of the foregoing type in which the dyes are added to the tabular grain silver halide emulsion prior to chemical sensitization.

EMBODIMENTS OF THE INVENTION

In the above formula I $R_1$ and $R_2$ are preferably halogen, particularly chlorine, or substituted or unsubstituted aryl (such as thienyl, furyl, phenyl, pyrrolyl and the like). For formula I and formula II, examples of acid or acid salt substituents for $X_1$, $X_2$, $X_4$ and $X_5$ include —$COO_2$—, a sulfo group or a group of the type —$CH_2$—CO—NH—$SO_2$—$CH_2$—, or phosphorous acids. Whatever the substituents, dyes of formula I should be anionic while those of formula II may be zwitterionic (that is, no net charge) or anionic. Particular examples for $X_1$, $X_2$, $X_4$ and $X_5$ may include 2-sulfoethyl, 3-sulfopropyl, 4-sulfobutyl, 3-sulfopentyl, 2-(sulfopropoxy)ethyl, 2-sulfatoethyl and the like. As already mentioned one of $X_4$ or $X_5$ should be a group of the foregoing type, while the other one may be a substituted or unsubstituted C1 to C6 alkyl or alkenyl (where "C1 to C6" represent the number of carbon atoms, that is 1 to 6 carbon atoms). As to $X_3$, it is particularly preferred that it be a substituted or unsubstituted methyl or ethyl (with ethyl, and particularly unsubstituted ethyl, being preferred). Examples of $R_3$ and $R_4$ may particularly include methyl, ethyl, allyl, butyl and the like, any of which may be substituted or unsubstituted (for example, $R_3$ or $R_4$ could be 2 hydroxyethyl or trifluorethyl).

As already mentioned, $R_5$ and $R_6$ are both strongly electron withdrawing groups. In addition, $R_8$ or $R_9$ could be a strong electron withdrawing group, although neither need be, as discussed above. By "strong electron withdrawing group", is meant one with a Hammett para sigma constant ($\sigma_p$) which is at least +0.30, preferably at least +0.40, and more preferably at least +0.50. Hammett $\sigma_p$ values are discussed in *Advanced Organic Chemistry* 3rd Ed., J. March, (John Wiley Sons, NY; 1985). Note that the "$_p$" subscript refers to the fact that the σ values are measured with the substituents in the para position. Values of $\sigma_p$ are also provided in Hansch and Leo, *Substituent Constants for Correlation Analysis in Chemistry & Biology,* John Wiley & Sons, NY (1979). Suitable groups include alkoxycarbonyl, alkylsulfonyl, sulfamoyl and the like. Particular examples of strong electron withdrawing groups (with their $\sigma_p$ indicated in parenthese) include carbamoyl (0.36), an ester (0.45), —$CF_3$ (0.54), —$SO_2$—$NH_2$ (0.57), —CN (0.66), —$SOCF_3$ (0.69), and —$SO_2$—$CH_3$ (0.72).

As to substituents, other than $R_1$ and $R_2$ which may be on the back rings of the above formulae I (by "back rings" is meant the benzyl ring fused with oxazole ring), such can include known substituents such as halogen (for example, chloro, fluoro, bromo, iodo), hydroxy, C1 to C3 alkoxy (for example, methoxy, ethoxy), substituted or unsubstituted C1 to C3 alkyl (for example, methyl, trifluoromethyl), alkenyl, thioalkyl (for example, methylthio or ethylthio), substituted and unsubstituted aryl (for example, phenyl, 5-chlorophenyl, although aryl groups are less preferred) and others known in the art. Subsituents on $R_1$ through $R_9$ can include halogen, hydroxy and the like.

Examples of M+ or N+ in the above formula I and II include, sodium ion, potassium ion, triethylammonium ion, pyridinium ion, and the like.

Examples of particular dyes of formula I and formula II of the present invention are provided below. These examples, of course, do not limit the scope of dyes of formula (I) or (II). Note that Ph=phenyl, Et=ethyl, Me=methy; also all of the particular dyes below have as an acid or acid salt substitutent on $X_1$ and $X_2$, and either or both of $X_4$ and $X_5$, —$SO_3$—, —$CO_2H$, —O—$SO_3$—, or —$SSO_3$—.

I-1
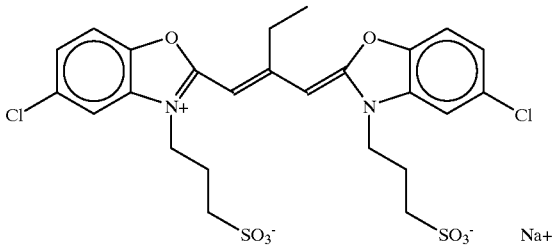
I-2
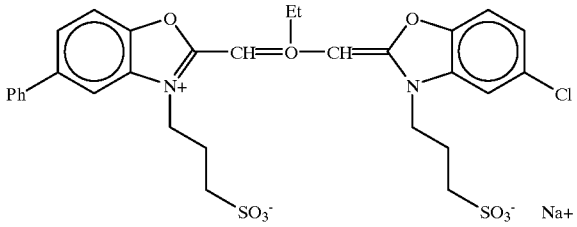
I-3
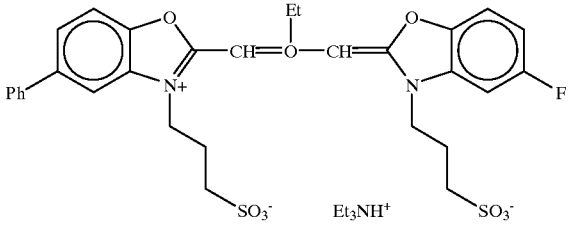
I-4
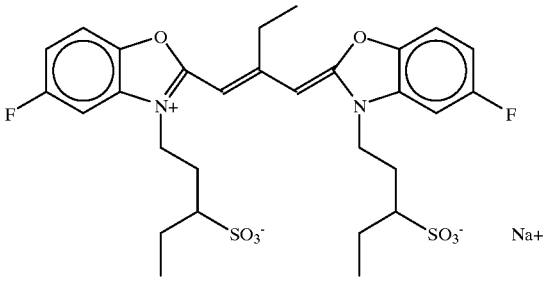
I-5
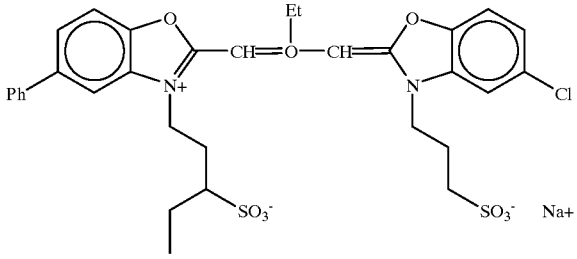
-continued
I-6
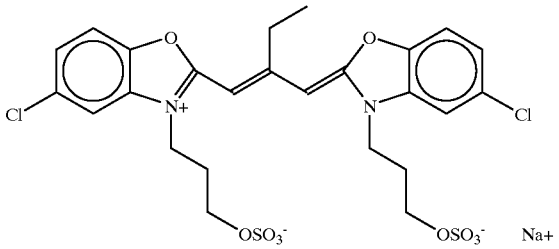
I-7
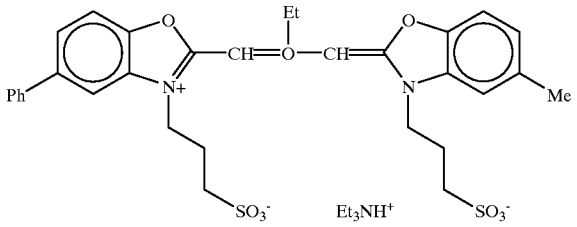
I-8
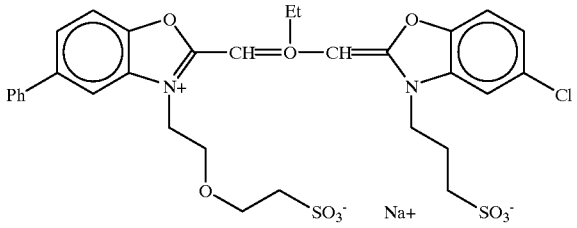
I-9
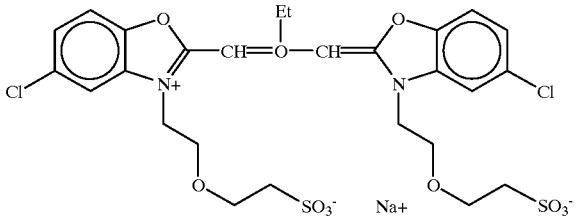
I-10
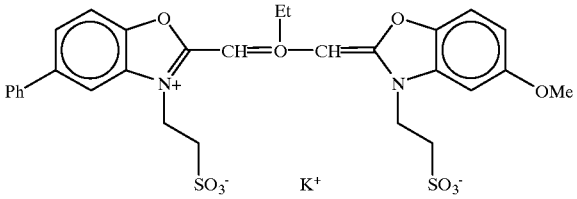
I-11
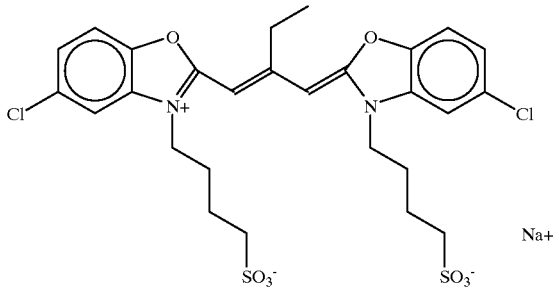

-continued
I-12
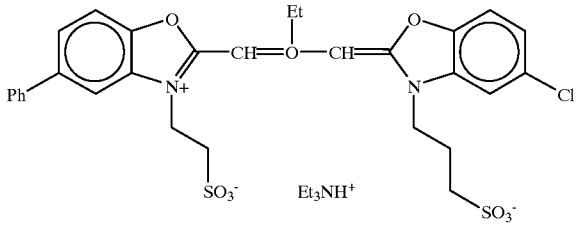
I-13
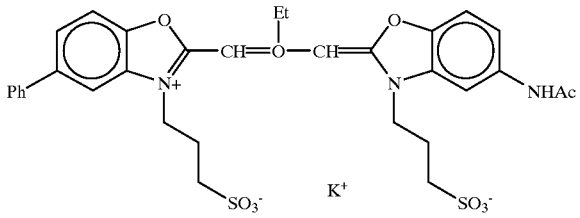
I-14
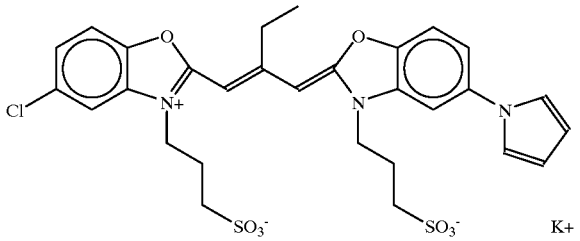
I-15
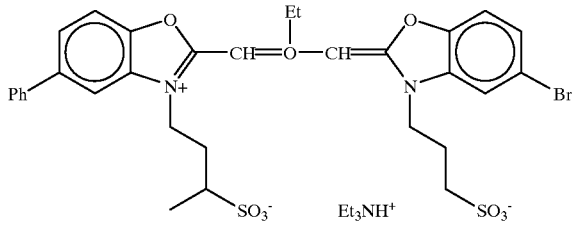
I-16
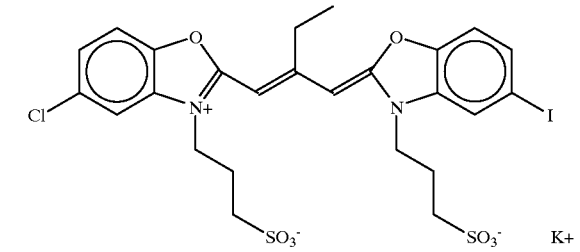
I-17
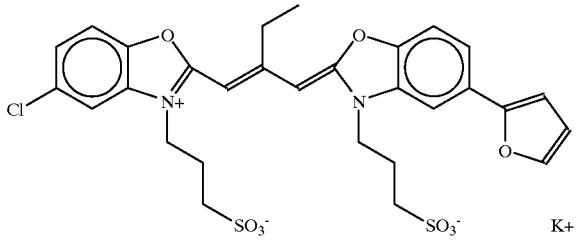
-continued
I-18
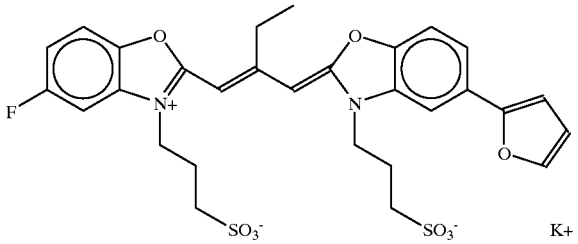
I-19
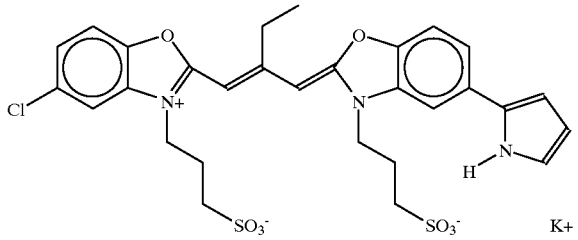
I-20
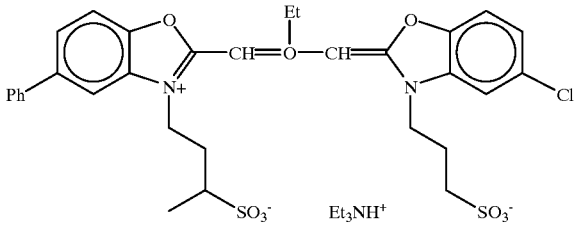
II-1
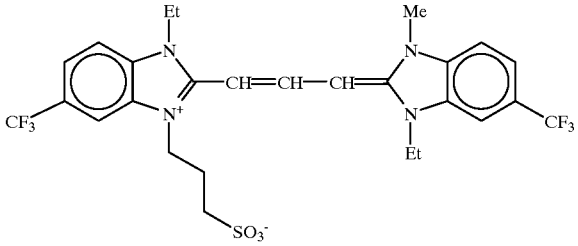
II-2
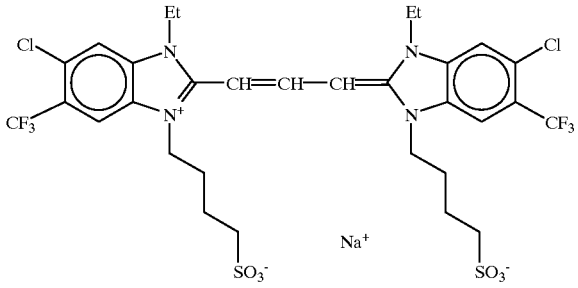

-continued
II-3
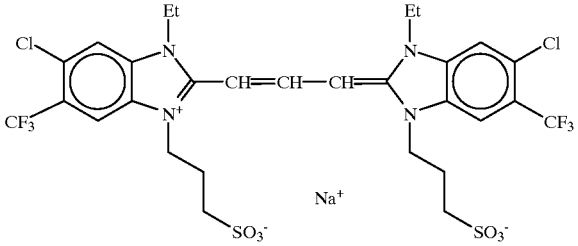
II-4
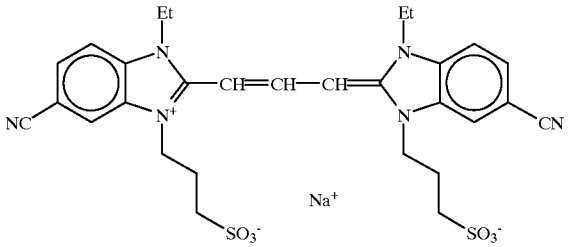
II-5
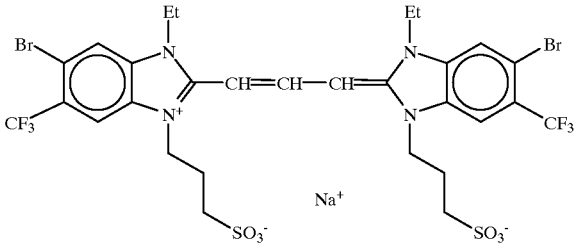
II-6
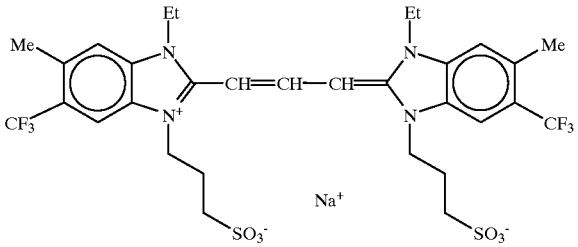
II-7
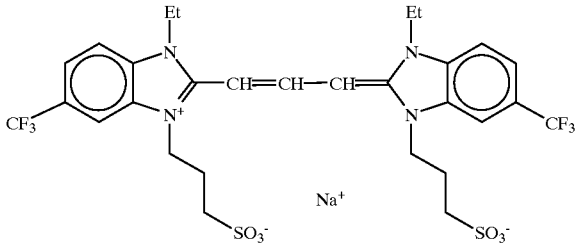
-continued
II-8
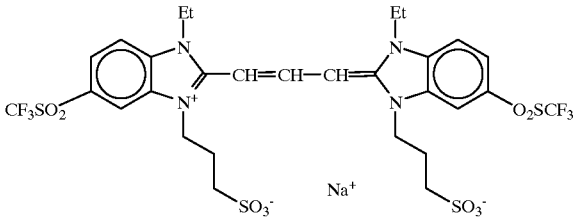
II-9
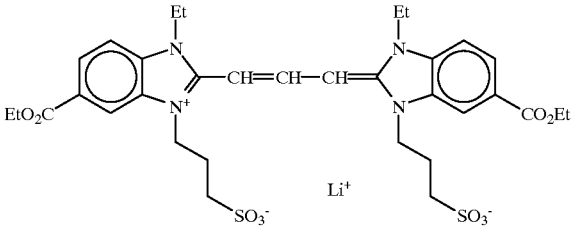
II-10
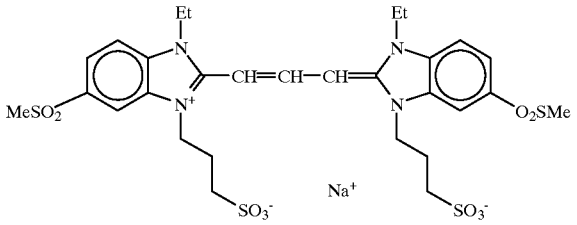
II-11
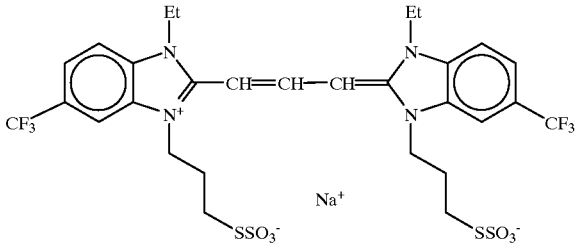
II-12
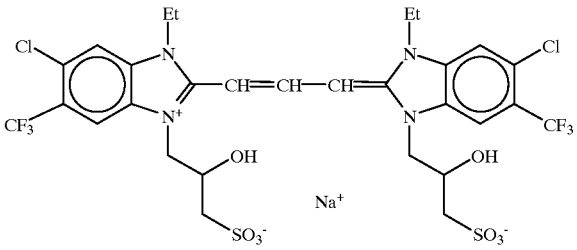

-continued
II-13
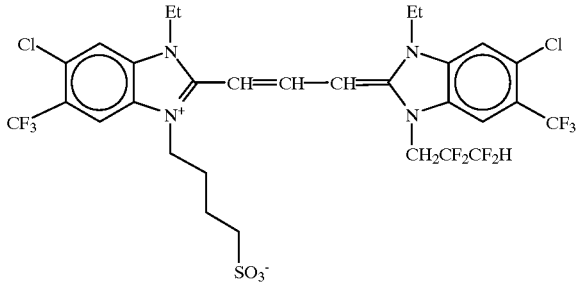
II-14
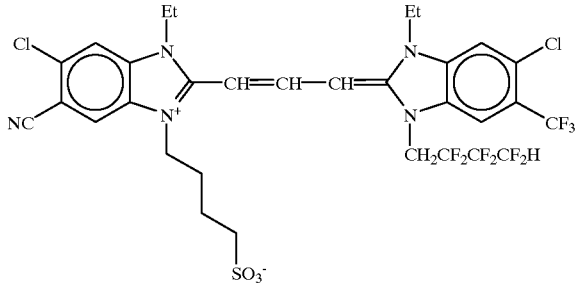
II-15
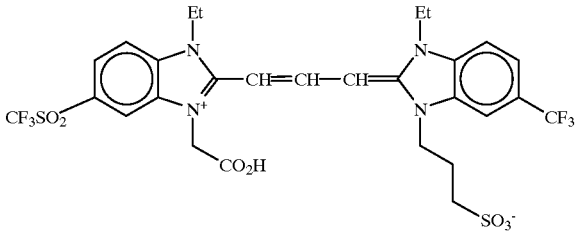
II-16
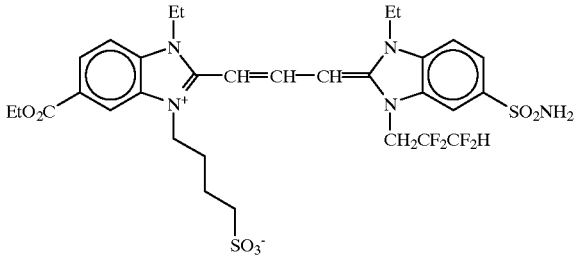
II-17
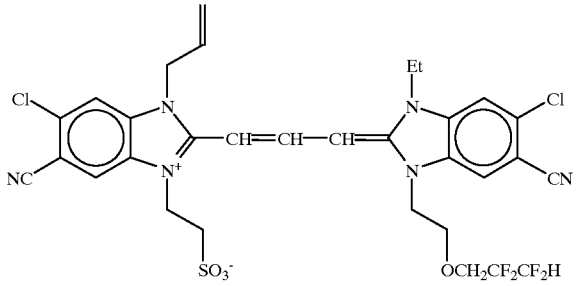
-continued
II-18
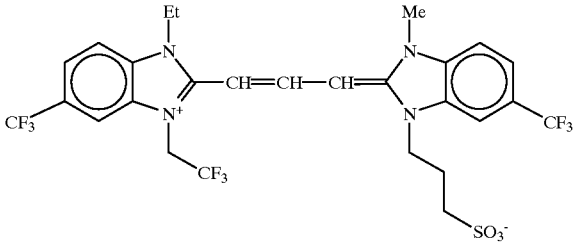
II-19
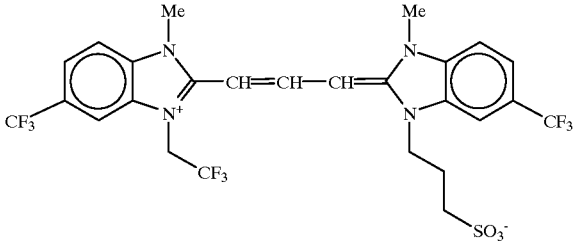
II-20
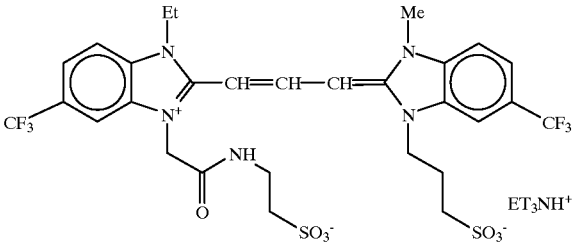
II-21
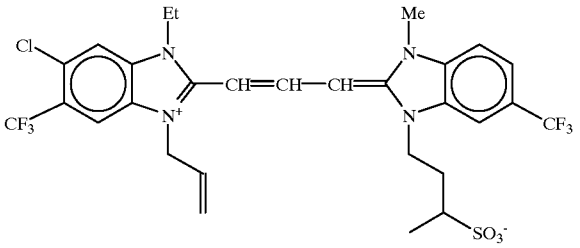
II-22
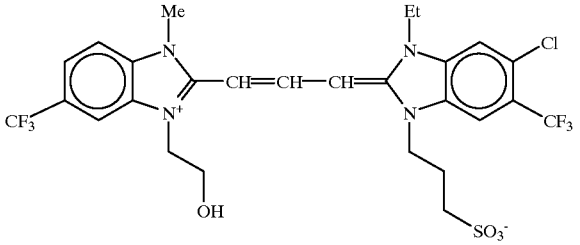

-continued

II-23

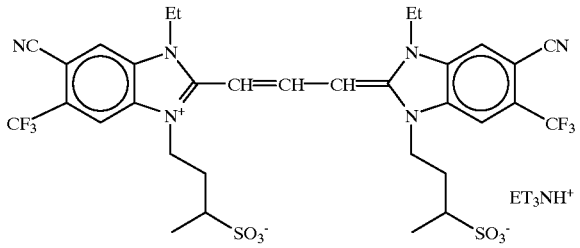

II-24

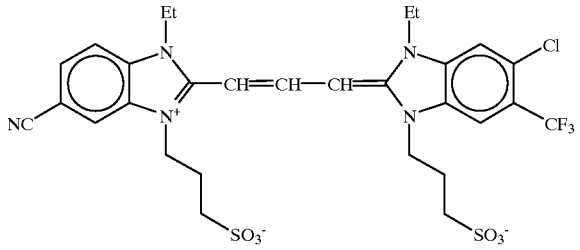

Dyes like those of Formula I and II are known in the art. They can be synthesized by the methods discussed in Hamer, *Cyanine Dyes and Related Compounds,* 1964 (publisher John Wiley & Sons, New York, N.Y.); James, *The Theory of the Photographic Process* 4th edition, 1977 (Eastman Kodak Company, Rochester, N.Y.), and U.S. Ser. No. 676,913. The dyes are used in combination using at least one dye of Formula I and at least one dye of Formula II. The ratio of the Formula I dye to the Formula II dye can be from 19:1 to 1:5, preferably from 9:1 to 1:2. The dyes may be used in a total amount of 0.1 mmole/mole silver to 5 mmole/mole silver, preferably from 0.5 to 3.0 mmole per mole of silver. The dyes may be added from solution in water, aqueous acid, or organic solvents; as gelatin dispersions or solid particle dispersions. They may be added one at a time in any order one after the other while holding the emulsion between their addition, or they may both be added separately at the same time, or they may be added after being premixed.

The combination of dyes is used to spectrally sensitize a tabular grain emulsion to green light. The dyes are preferably added to the emulsion before the chemical sensitizers are added. In the present application, a tabular grain emulsion means that the emulsion grains have two essentially flat parallel faces that account for most of the surface area. In addition, greater than 50 percent of the total projected area of the emulsion grains are accounted for by tabular grains having a thickness of less than 0.3 $\mu$m (0.5 $\mu$m for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in $\mu$m and t is the average thickness in $\mu$m of the tabular grains.

Tabular grain emulsions suitable for the present invention are disclosed by Wey U.S. Pat. Nos. 4,399,215; Kofron 4,434,226; Maskasky 4,400,463; and Maskasky 4,713,323; as well as disclosed in allowed U.S. applications: Ser. No. 819,712 (filed Jan. 13, 1992), Ser. No. 820,168 (filed Jan. 13, 1992), Ser. No. 762,971 (filed Sep. 20, 1991), Ser. No. 763,013 (filed Jan. 13, 1992), and pending U.S. application Ser. No. 763,030 (filed Sep. 20, 1992). The grain size of the silver halide may have any distribution known to be useful in photographic compositions, and may be either polydispersed or monodispersed.

The tabular emulsion may be of any halide type, for example, chloride, chlorobromide, bromide, bromoiodide, or chlorobromoiodide; but preferably will be silver bromide or silver bromoiodide, including structured iodide. The iodide content generally will be from 0 to about 20%, preferably from 0 to 12%.

The silver halide grains to be used in the invention may be prepared according to methods known in the art, such as those described in *Research Disclosure,* (Kenneth Mason Publications Ltd, Emsworth, England) Item 308119, December, 1989 (hereinafter referred to as *Research Disclosure I*) and James, *The Theory of the Photographic Process.* These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation. Other useful sensitization means include sensitization by rapid sulfur sensitizers (DCT) such as disclosed in U.S. Pat. No. 4,810,626, or by gold complexes as described in U.S. Pat. Nos. 5,049,485 and 5,049,484.

The silver halide to be used in the invention may be advantageously subjected to chemical sensitization using compounds and techniques known in the art, such as described in *Research Disclosure I* and the references cited therein. In addition, the methods as described in H. Frieser ed., *Die Grundlagen Der Photographischen Prozesse mit Silberhalogeniden*, Akademische Verlagsgesellschaft, pages 675 to 734 (1968) can also be used for chemical sensitization. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions. These include chemical sensitizers, such as active gelatin, sulfur, selenium, tellurium, gold, platinum, palladium, iridium, osmium, rhenium, phosphorous, or combinations thereof. Chemical sensitization is generally carried out at pAg levels of from 5 to 10, pH levels of from 3 to 8, and temperatures of from 30 to 80° C., as illustrated in *Research Disclosure,* June 1975, item 13452 and U.S. Pat. No. 3,772,031.

Essentially any type of emulsion (e.g., negative-working emulsions such as surface-sensitive emulsions of unfogged internal latent image-forming emulsions, direct-positive emulsions such as surface fogged emulsions, or others described in, for example, *Research Disclosure I*) may be used.

The photographic emulsion used in the present invention may include various compounds for the purpose of preventing fog formation or of stabilizing photographic performance in the photographic light sensitive material during the production, storage or photographic processing thereof. For example, those compounds known as antifoggants or stabilizers can include azoles such as benzothiazolium salts; nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particular 1-phenyl-5-mercaptotetrazole), and the like.; mercaptopyrimidines; mercaptotriazines; thioketo compounds such as oxazolinethione, and the like.; azaindenes such as triazaindenes, tetraazaindenes (particularly 4-hydroxysubstituted (1,3,3a,7)tetraazaindenes), pentaazaindenes, etc.; benzenethiosulfonic acids; benzenesulfinic acids; benzenesulfonic amides; aryl thiosulfonates and the like as stabilizers or antifoggants. Disulfide antifoggants may also be used.

Other addenda in the emulsion may include oxidized developer scavangers and filter dyes (including solid particle filter dyes) such as described in U.S. Pat. Nos. 4,855,221; 4,857,446; 4,988,611; 4,900,653; 4,948,717, 4,948,718, 4,950,586; and 4,940,654. Further addenda include light absorbing or reflecting pigments, vehicle hardeners such as gelatin hardeners, coating aids, dye-forming couplers (usually magenta dye forming couplers in the case of emulsions sensitized with the dyes of formula I and II herein), and development modifiers such as development inhibitor releasing (DIR) couplers, timed development inhibitor releasing couplers, ultraviolet absorbers, bleach accelerators, and the like. These addenda and methods of their inclusion in emulsion and other photographic layers are well-known in the art and are disclosed in *Research Disclosure I* and the references cited therein. The emulsion may also include brighteners, such as stilbene brighteners. Such brighteners are well-known in the art.

The emulsion layer containing silver halide sensitized with dyes of the present invention can be coated simultaneously or sequentially with other emulsion layers, subbing layers, filter dye layers, interlayers, or overcoat layers, all of which may contain various addenda known to be included in photographic elements. These include antifoggants, oxidized developer scavengers, DIR couplers (which class includes DIAR couplers), antistatic agents, optical brighteners, light-absorbing or light-scattering pigments, and the like. The layers of the photographic element can be coated onto a support using techniques well-known in the art. Supports can be transparent or can be reflective (for example, a paper support). These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

Photographic elements of the present invention can be black and white or color. A color photographic element generally contains three silver emulsion layers or sets of layers (each set of layers often consisting of emulsions of the same spectral sensitivity but different speed): a blue-sensitive layer having a yellow dye-forming color coupler associated therewith; a green-sensitive layer having a magenta dye-forming color coupler associated therewith; and a red-sensitive layer having a cyan dye-forming color coupler associated therewith. Those dye forming couplers are provided in the emulsion typically by first dissolving or dispersing them in a water immiscible, high boiling point organic solvent, the resulting mixture then being dispersed in the emulsion. Suitable solvents include those in European Patent Application 87119271.2. Dye-forming couplers are well-known in the art and are disclosed, for example, in *Research Disclosure I.*

Photographic elements of the present invention may also usefully include a magnetic recording material as described in *Research Disclosure*, Item 34390, November 1992.

Photographic elements comprising the composition of the invention can be processed in any of a number of well-known photographic processes utilizing any of a number of well-known processing compositions, described, for example, in *Research Disclosure I,* or in James, *The Theory of the Photographic Process* 4th, 1977. In the case of processing a reversal color element, the element is first treated with a black and white developer followed by treatment with a color developer. Such processing further includes rapid processing of the type described in, for example, U.S. Pat. No. 4,892,804.

The invention is illustrated further in the following Examples. All dye levels expressed below are expressed in mmoles per mole of silver unless otherwise indicated. All silver halide emulsion particle sizes given are average figures obtained by disc centrifuge, unless otherwise indicated.

EXAMPLE 1

A 1.07 micron (equivalent circular diameter) by 0.12 micron thick bromoiodide emulsion (3% iodide) was prepared by uniformly adding 1.5% iodide salt through the precipitation and dumping 1.5% iodide in the form of AgI seed crystals at 70% of the bromide addition. Sample 1-1 was then prepared by spectrochemically sensitizing the emulsion in the following way:

The emulsion and gelatin (40 g/kg) were melted at 40° C.

Sodium thiocyanate (150 mg/mole of silver) was added. Held for 20 minutes.

Dye I-20 (0.659 mmole/mole of silver) was added as a gelatin dispersion.

Held for 30 minutes.

VAg was adjusted to +91 mV.

Potassium tetrachloroaurate (3 mg/mole of silver) was added.

Held 2 minutes.

Sodium thiosulfate pentahydrate (6 mg/mole of silver) was added.

Held 2 minutes.

3-Methylbenzothiazolium iodide (30 mg/mole of silver) was added.

Held 2 minutes.

Temperature was increased at a rate of 5 degrees/3 minutes to 70° C.

Held 5 minutes.

Temperature was decreased at a rate of 5 degrees/3 minutes to 40° C.

The emulsion was then diluted with more gelatin and mixed with 1,3,3a,7 tetraazaindene (1.75 g/silver mole), coupler dispersion D-1, coupler dispersion D-2, surfactant SF-1 (0.051% by weight), and surfactant SF-2 (0.035% by weight), and coated on a 5 mil cellulose acetate support which had been previously coated with remjet antihalation backing and subbed with 4.89 g gelatin/$m^2$. The sensitized emulsion and couplers were coated on the support at a level of 807 mg silver/sq. m., 1.61 g gel/sq. m., 323 mg M-1/sq. m., and 32 mg M-2/sq. m. The emulsion layer was then overcoated with 2.15 g gel/sq. m. and hardened with 1.75% of bis(vinylsulfonylmethyl)ether based on the total amount of gel. Samples 1-2 through 1-13 were similarly prepared except that the dye combinations listed in Table I were used instead of dye I-20 alone, and each dye was added separately with a 15 minute hold afterward (Dye I added first then Dye II).

Dispersion D-1 was composed of the following:

6% by weight coupler M-1
3% by weight 2,4-di-t-butylphenol
3% by weight 9-octadecen-1-ol
6% by weight ethyl acetate
8% by weight gelatin
0.6% by weight tri(isopropyl)naphthalenesulfonic acid sodium salt
pH adjusted to 5.1 with propionic acid with the remainder being water.

Dispersion D-2 was composed of the following:

2.205% by weight coupler M-2
4.410% tricresyl phosphate
3.31% by weight triethyl phosphate
3.31% by weight 2-(2-butoxy)ethoxyethyl acetate
0.663% by weight triethylamine
10% by weight gelatin
0.6% by weight tri(isopropyl)naphthalenesulfonic acid sodium salt
pH adjusted to 5.1 with propionic acid with the remainder being water.

Surfactant SF-2 is Olin 10G®

SF-1

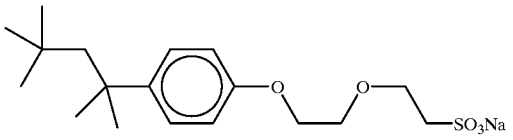

-continued

Coupler M-1

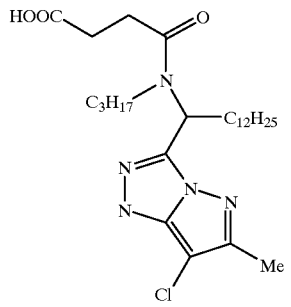

Coupler M-2

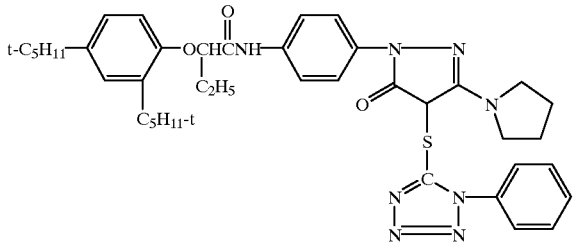

Coupler M-2

One strip from each sample was then stored under oxidative conditions for 3 days to simulate natural aging of the coating. The aged strip was then exposed and processed together with an identical strip that had not been oxidatively treated. The strips were exposed using a 5500 K light source for 1/50" through a WRATTEN® 9 filter and a 0–4 log E step tablet with 0.2 log E increments. They were then processed uing KODAK FLEXICOLOR C41® process as described in *Brit. J. Photog. Annual* 1988, p196–198 with the exception that the composition of the bleach solution was changed to comprise propylenediaminetetraacetic acid.

The minimum density was measured and the photographic speed determined as 100 times the log of the exposure required to give a density 0.15 above the minimum density (fog). The difference in sensitivity between the oxidatively aged and non-aged strips was also determined as a loss in speed for the aged strips. In addition, a measurement of retained dye stain was obtained by processing unexposed strips through the same processing solutions in the order: fix, develop, bleach, fix, stabilizer. These strips were then analyzed for coloration using a scanning spectrophotometer. Residual coloration is due to retained sensitizing dye and was recorded as the optical density at the wavelength of maximum absorption ($\lambda_{max}$). The data is summarized in Table I.

TABLE I

| Sample | Dye I Amount mM/mol | Dye II Amount mM/mol | Dmin (fog) | Speed at 0.15 > fog | Aged Speed at 0.15 > fog | Speed loss | Stain density (λmax) |
|---|---|---|---|---|---|---|---|
| 1-1 (C) | I-20 0.659 | none | 0.15 | 243 | 239 | −4 | 0 |
| 1-2 (C) | I-20 0.659 | S-1 0.216 | 0.19 | 266 | 249 | −17 | 0 |
| 1-3 (I) | I-1 0.438 | II-19 0.438 | 0.25 | 249 | 240 | −9 | 0 |

TABLE I-continued

| Sample | Dye I Amount mM/mol | Dye II Amount mM/mol | Dmin (fog) | Speed at 0.15 > fog | Aged Speed at 0.15 > fog | Speed loss | Stain density (λmax) |
|---|---|---|---|---|---|---|---|
| 1-4 (I) | I-20 0.659 | II-3 0.216 | 0.34 | 267 | 258 | −9 | 0 |
| 1-6 (I) | I-12 0.659 | II-2 0.216 | 0.35 | 256 | 250 | −6 | 0 |
| 1-7 (C) | S-2 0.659 | II-3 0.216 | 0.23 | 241 | 233 | −8 | 0.06 (513) |
| 1-8 (C) | S-3 0.659 | II-2 0.216 | 0.43 | 239 | 228 | −11 | 0.099 (554) |
| 1-9 (C) | S-3 0.659 | II-4 0.216 | 0.40 | 247 | 230 | −17 | 0.099 (554) |
| 1-10 (C) | S-3 0.659 | S-4 0.216 | 0.73 | 229 | 201 | −28 | 0.102 (554) |
| 1-11 (C) | I-20 0.659 | S-4 0.216 | 0.86 | 222 | 194 | −28 | 0 |
| 1-12 (C) | I-12 0.659 | S-5 0.216 | 0.39 | 252 | 231 | −21 | 0 |
| 1-13 (C) | I-20 0.659 | S-6 0.216 | 0.32 | 254 | 226 | −28 | 0 |

NOTE:

(C) indicates a comparison (I) indicates a dye combination of the present invention Dyes used in the comparisons were:

S-1

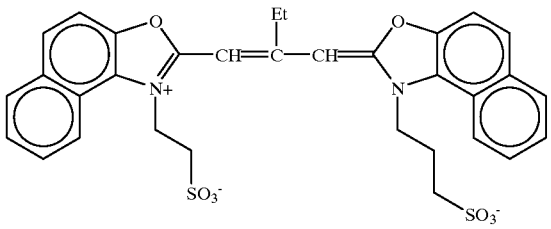

S-2

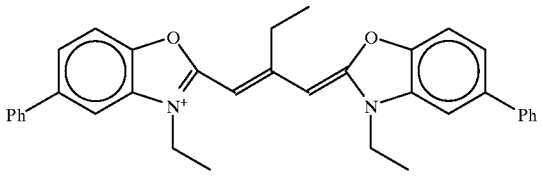

(a dye of GB 1,231,079)

S-3

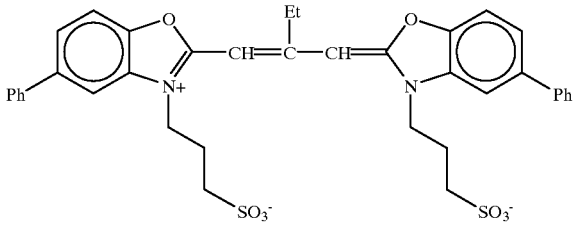

(a dye of GB 1,231,079 and US 4,544,628)

-continued

S-4

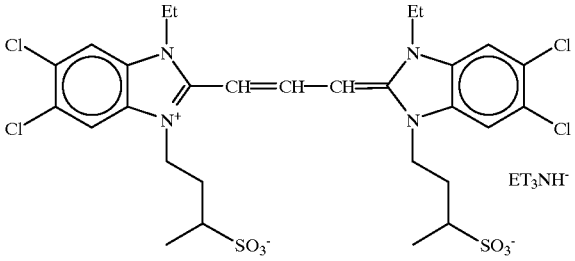

(a dye of US 4,701,405)

S-5

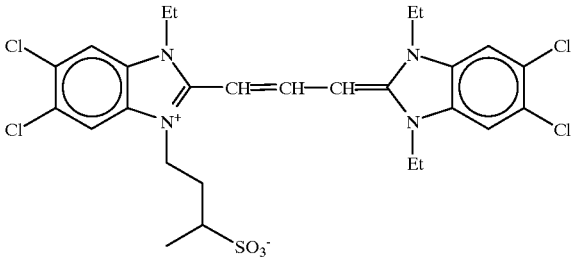

(a dye of US 4,814,264)

S-6

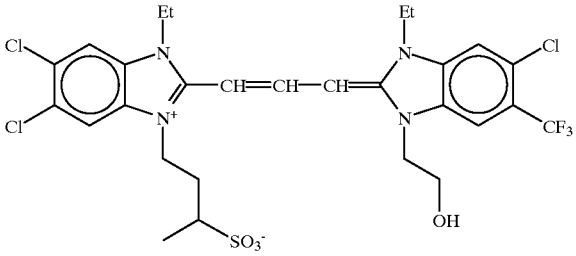

The data in Table I demonstrates that some comparison examples (samples 1-7 and 1-8) show minimal speed loss with aging, but these have unacceptable levels of retained sensitizing dyes. Other comparisons (1-2 and 1-9 to 1-13) have large speed losses with aging. In addition, comparisons 1-10 and 1-11 have very high fog and lower speed. Only the dye combinations of the invention show enhanced photographic sensitivity relative to the single dye stain.

EXAMPLE 2

Sample 2-1 was prepared using a monodispersed 100% AgBr tabular grain emulsion (2.7 micron ecd×0.125 micron thickness, coefficient of variation=9%). The emulsion was spectrochemically finished int he following way:

- Emulsion and gelatin (40 g/kg of emulsion) were melted at 40° C.
- Dye I-1 (400 mg/mole of silver) was added
- Held 20 minutes
- Sodium aurous dithiosulfate (5 mg/mole of silver) was added
- Held 5 minutes
- Sodium thiocyanate (150 mg/mole of silver) was added
- Held 5 minutes
- Finish modifier FM-1 (16 mg/mole silver) was added
- Held 5 minutes
- Potassium selenocyanate (0.5 mg/mole of silver) was added Held 5 minutes Temperature increased at a rate of 5 degrees per 3 minutes to 70° C.

Held 12 minutes

Temperature dropped rapidly to 40° C.

Potassium iodide (300 mg/mole silver) was added 1,3,3a,7-tetraazaindene (2.2g/mole of silver) was added.

Sample 2-2 was prepared similarly except that 400 mg of dye II-19 was added, the sodium aurous dithiosulfate was reduced to 3 mg/mole of silver and potassium iodide was omitted. Sample 2-3 was prepared similarly to sample 2-2 except that 200 mg of dye I-1 was added followed after 5 minutes by 200 mg of dye II-19. The emulsions were diluted with coating gelatin followed by addition of latex polymer, 3,5-disulfocatechol disodium salt, 2-methyl-2,4-pentanediol, 0.075% SF-1 surfactant, and 0.037% Olin 10G® surfactant.

These samples were coated on a 7 mil polyester support which had been previously coated with an antihalation layer. The coated levels were 2.15 g/m$^2$ silver, 3.23 g/m$^2$ gelatin, 0.54 mg/m$^2$ latex polymer, 108 mg/sq. m. 3,5-disulfocatechol disodium salt, and 0.634 mL of 2-methyl-2,4-pentanediol/m$^2$. The emulsion layer was then overcoated with 721 mg gel/m$^2$ using the same surfactants and hardened with bis(vinylsulfonylmethyl)ether at a level of 1% of the total gelatin.

The samples were exposed with a 2850 K tungsten light source for 0.01 second through a Corning 4010 filter and a 0–4 log E stepped tablet with 0.2 log E increments between steps. The exposed strips were processed in RP-X-OMAT® chemistry. The speed was measured as 100 times the log exposure necessary to produce a density of 0.2 above minimum density (referenced as fog or Dmin). Film strips of each sample were kept for 16 weeks under ambient conditions then exposed and processed again as a test for stability. The change in speed is shown in Table II. The results are shown in Table II.

TABLE II

| Sample | Dye I Level | Dye II Level | Dmin | Speed | Stain (λmax) | ΔSpeed (16 wks) |
|---|---|---|---|---|---|---|
| 2-1 (C) | I-1 400 mg/mole | none | 0.07 | 217 | 0.023 (505) | 0 |
| 2-2 (C) | none | II-19 400 mg/mole | 0.65 | 229 | high fog | −6 |
| 2-3 (I) | I-1 200 mg/mole | II-19 200 mg/mole | 0.07 | 235 | 0.014 (510) | −4 |

NOTE: (C) indicates a comparison
(I) indicates a dye combination of the present invention The data in Table II show that the combination of dyes in sample 2-3 gives excellent speed, without a penalty of increased fog. Also, the level of retained sensitizing dye stain in samples 2-3 is greatly reduced compared to that in sample 2-1, and all samples show minimum speed loss with storage.

EXAMPLE 3

A multilayer photographic film element was prepared by coating a cellulose triacetate film support with the following layers in sequence (coverages are in grams per meter squared)

Layer 1 (Antihalation layer): black colloidal silver sol containing 0.215 g of silver, cyan dye material CD-1 (0.032), magenta dye material MD-1 (0.022), yellow dye material YD-1 (0.129) and gelatin (2.44) were contained in this layer.

Layer 2 (Lowest Sensitivity Red-sensitive layer): This layer comprised a blend of a red-sensitized, tabular grain silver iodobromide emulsion (1.3% iodide, 0.50 microns diameter by 0.08 microns thick) (0.22) and a red-sensitized tabular grain silver iodobromide emulsion (4.5% iodide, 1.00 microns diameter by 0.09 microns thick) (0.32). A cyan dye-forming coupler C-1 (0.54) and a BAR coupler B-1 (0.09) were incorporated in this layer. Gelatin was also included (1.78).

Layer 3 (Medium Sensitivity Red-sensitive layer): This layer comprised a red-sensitized, tabular grain, silver iodobromide emulsion (4.5% iodide, 1.31 diameter by 0.12 microns thick) (0.54). This layer also comprised a cyan dye-forming coupler C-1 (0.23), a cyan dye-forming masking coupler CM-1 (0.022), DIR coupler D-1 (0.05), and a BAR coupler B-1 (0.003). Gelatin (1.66) was included.

Layer 4 (Highest Sensitivity Red-sensitive layer): This layer comprised a red-sensitized, tabular grain, silver iodobromide emulsion (4.5% iodide, 2.70 diameter by 0.13 microns thick) (1.08). This layer also comprised a cyan dye-forming coupler C-1 (0.17), a cyan dye-forming masking coupler CM-1 (0.050), DIR coupler D-1 (0.05), and a BAR coupler B-1 (0.002). Gelatin (1.36) was included.

Layer 5 (Interlayer): This layer comprised gelatin (1.33).

Layer 6 (Lowest Sensitivity Green-sensitive layer): This layer comprised a blend of a green-sensitized, tabular grain, silver iodobromide emulsion (1.3% iodide, 0.54 microns diameter by 0.08 microns thick) (0.59) and a green-sensitized, tabular grain, silver iodobromide emulsion (4.5% iodide, 1.03 microns diameter by 0.09 microns thick) (0.32). This layer also comprised a blend of magenta dye-forming couplers: M-1 (0.22) and M-2 (0.09). The layer also incorporated a BAR coupler B-2 (0.03) and gelatin (1.78).

Layer 7 (Medium Sensitivity Green-sensitive layer): This layer comprised a green-sensitized, tabular grain, silver iodobromide emulsion (4.5% iodide, 1.22 microns diameter by 0.11 microns thick) (0.97), a blend of magenta dye-forming couplers M-1 (0.09) and M-2 (0.03), and a magenta dye-forming masking coupler MM-1 (0.09). This layer also incorporated DIR coupler D-2 (0.02), BAR coupler B-1 (0.003), and gelatin (1.48).

Layer 8 (Highest Sensitivity Green-sensitive layer): This layer comprised a green-sensitized, tabular grain, silver iodobromide emulsion (4.5% iodide, 2.23 microns diameter by 0.13 microns thick) (0.97), a blend of magenta dye-forming couplers M-1 (0.09) and M-2 (0.03), and a magenta dye-forming masking coupler MM-1 (0.05). This layer also incorporated DIR coupler D-2 (0.01), DIR coupler D-3 (0.01), BAR coupler B-1 (0.003), and gelatin (1.33).

Layer 9 (Yellow filter layer): This layer comprised yellow dye material YD-2 (0.11) and gelatin (1.33).

Layer 10 (Lowest Sensitivity Blue-sensitive layer): This layer comprised a blend of a blue-sensitized, tabular grain, silver iodobromide emulsion (1.3% iodide, 0.54 microns diameter by 0.08 thick) (0.16), a blue-sensitized, tabular grain silver iodobromide emulsion (4.5% iodide, 1.02 micron diameter by 0.09 micron thick) (0.27), and a blue-sensitized, tabular grain, silver iodobromide emulsion (4.5% iodide, 1.38 microns diameter by 0.11 microns thick) (0.38). This layer incorporated a yellow dye-forming coupler Y-1 (0.91), DIR coupler D-4 (0.05), and BAR coupler B-1 (0.003), and gelatin (2.60).

Layer 11 (Highest Sensitivity Blue-sensitive layer): This layer comprised a blue-sensitized, conventional 3-D grain, silver iodobromide emulsion (12% iodide, 1.0 micron) (0.38) and a blue-sensitized, tabular grain, silver iodobromide emulsion (4.5% iodide, 3.53 microns diameter by 0.14 microns thick) (0.38). This layer also incorporated yellow dye-forming coupler Y-1 (0.27), DIR D-4 (0.04), BAR B-1 (0.005), and gelatin (1.97).

Layer 12 (UV filtration layer): This layer comprised dye UV-1 (0.11), UV-2 (0.11), and unsensitized silver bromide Lippman emulsion (0.22). Gelatin was included (1.11).

Layer 13 (Protective layer): This layer comprised gelatin (0.92) and matte polymethylmethacrylate beads (0.054).

This film was hardened at coating with 1.75% by weight of total gelatin of hardener H-1. Surfactants, coating aids, oxidized developer scavengers, soluble absorber dyes and stabilizers were added to the various layers of this sample as is commonly practiced in the art.

C-1

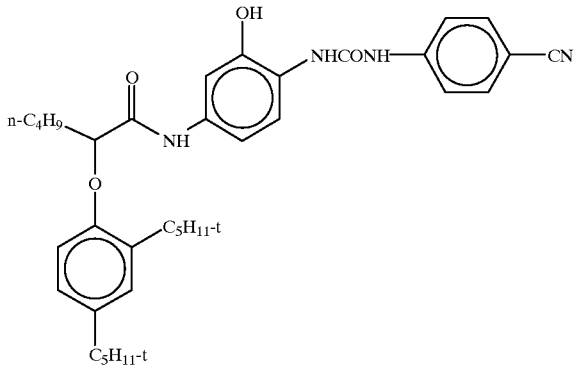

CM-1

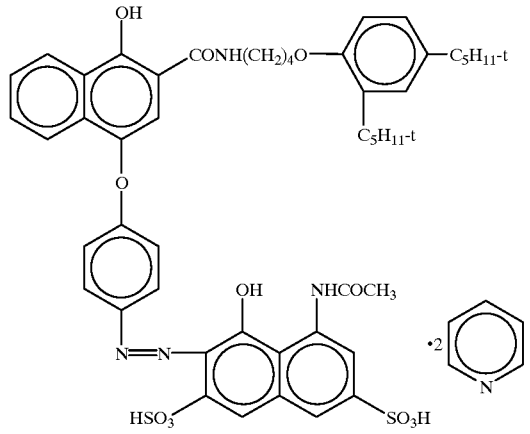

B-1

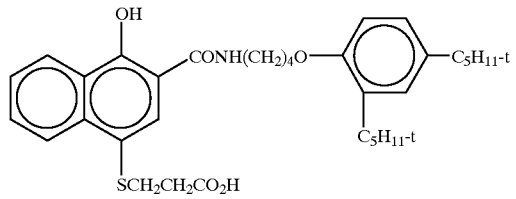

B-2

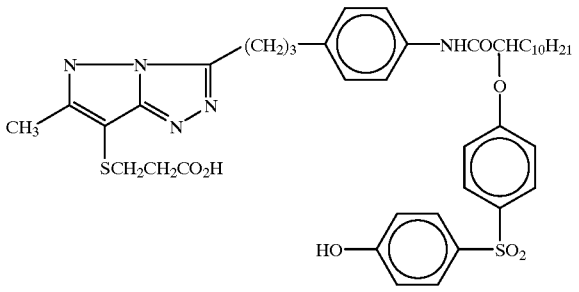

-continued
MD-1
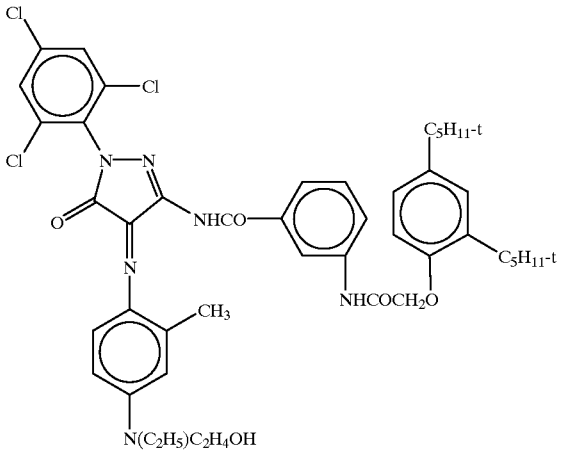
D-1
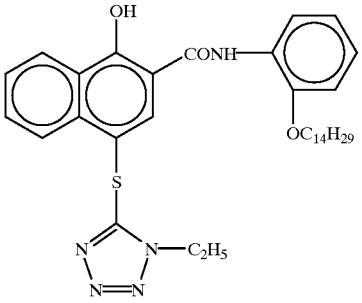
D-2
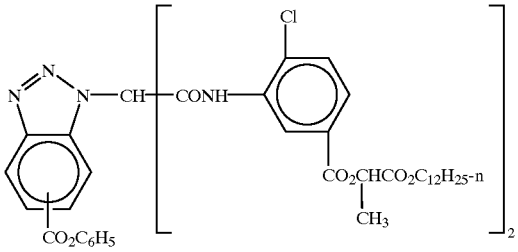
D-3
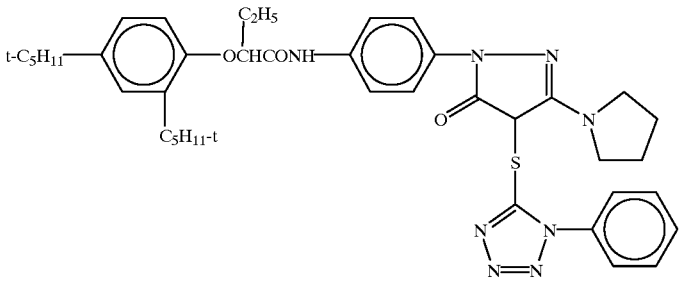

-continued
D-4
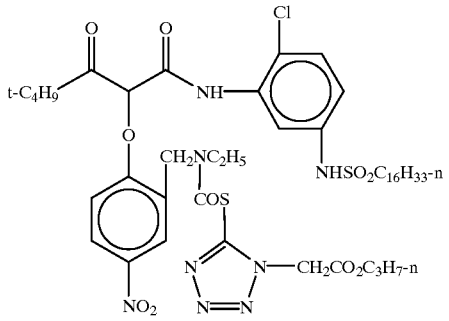
M-1
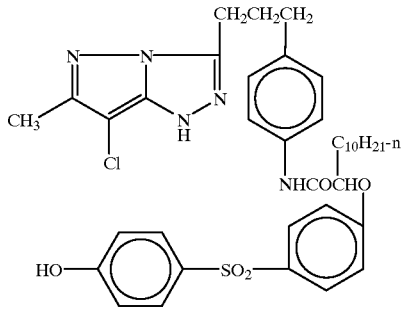
M-2
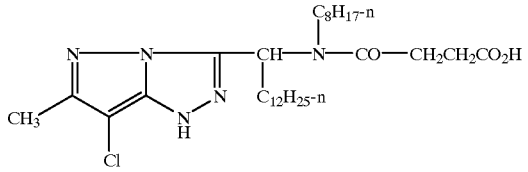
M-3
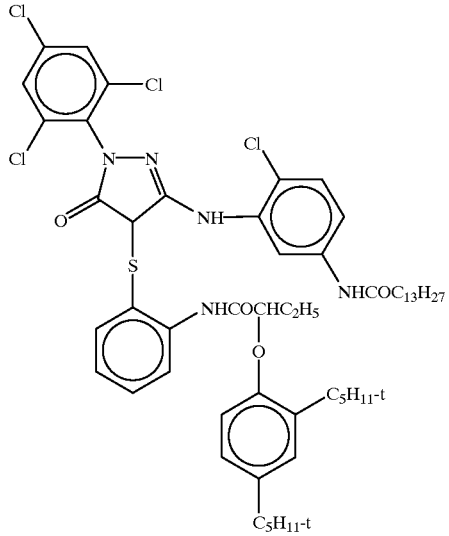

-continued
MM-1
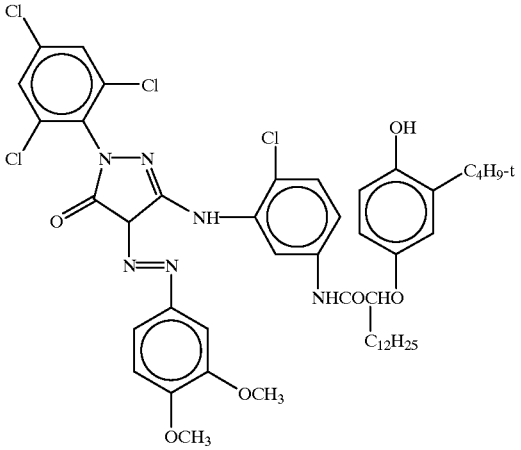
Y-1
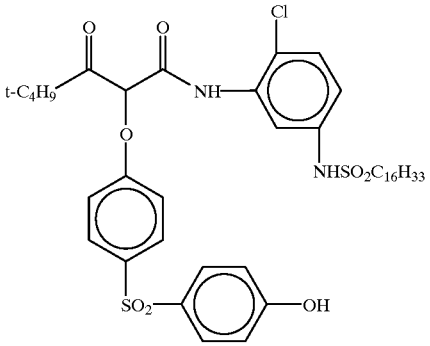
YD-1
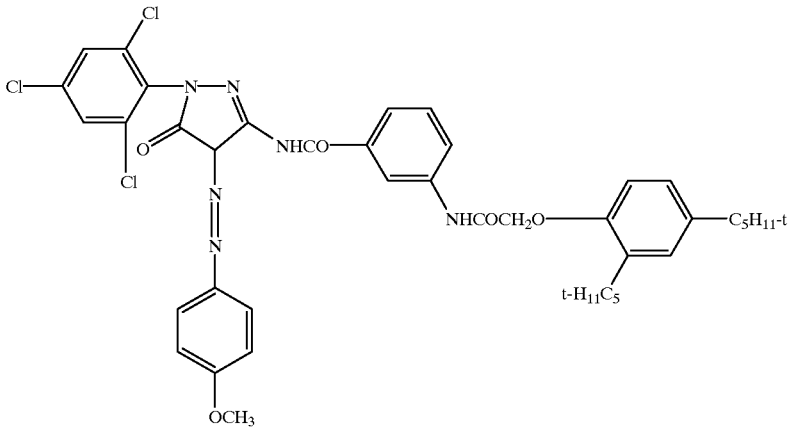
YD-2
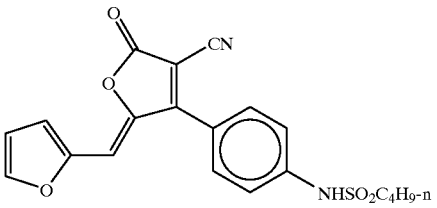

-continued

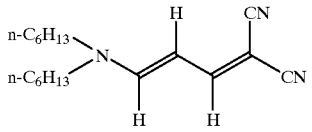

UV-1

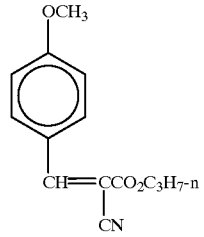

UV-2

H-1:

$CH_2(SO_2CH{=}CH_2)_2$

CD-1

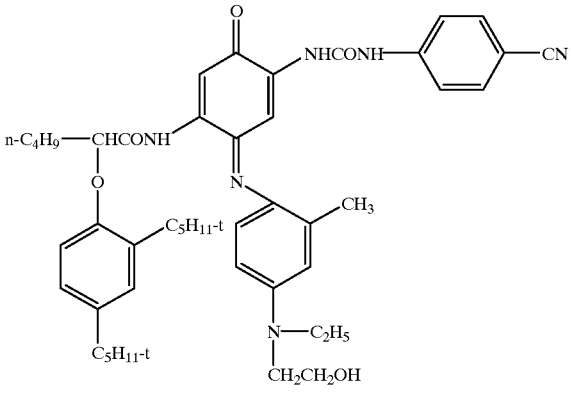

FM-1

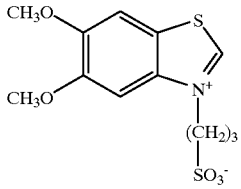

Note that M-1 and M-2 together could readily be replaced with M-3 in the above multi-layer element, although M-3 was not used in the particular multi-layer element from which the following data was obtained.

The emulsions in layers 6, 7, and 8 (the low, medium, and high sensitivity green sensitive layers), were spectrally sensitized with a 3 to 1 ratio of dye I-20 to dye S-1. This element constitutes sample 3-1. Sample 3-2 was prepared identically to 3-1 except that dye II-3 was substituted for dye S-1. When imagewise exposed through a graduated step wedge to a light source at 5500 deg K, these two materials demonstrated nearly identical photographic response to green light (processing of the strips was the same as in Example 1. Strips of sample 3-1 and 3-2 were also kept for 6 months at 78° F. and 50% relative humidity, while identical strips were stored at 0° F. and 50% relative humidity. The strips were then exposed and processed as before. The 78° F. strip of sample 3-1 showed a 0.12 log E green speed loss relative to the 0° F. reference. However, the 78° F. strip of sample 3-2 (invention) showed only a 0.05 log E speed loss relative to its 0° F. reference.

The present invention has been described in detail with particular reference to preferred embodiments, but it will be understood that variations and modifications can be effected within the spirit and scope of the invention.

What is claimed is:

1. A silver halide photographic element comprising a tabular grain silver halide emulsion containing at least one green spectral sensitizing dye of formula I, and at least one green spectral sensitizing dye of formula II:

(I)

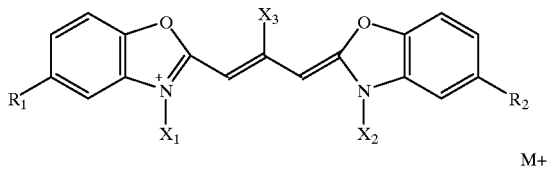

M+ wherein R1 and R2 may be the same or different and are selected from substituted or unsubstituted C1 or C2 alkyl, substituted or unsubstituted C1 or C2 alkoxy, halogen, substituted or unsubstituted amido, carbamoyl, or substituted or unsubstituted aryl, provided that R1 and R2 are not both aryl, and the benzo back rings may optionally be further substituted;

X3 is a substituted or unsubstituted C1 to C3 alkyl or alkenyl;

X1 and X2 are acid or acid salt substituted C1 to C6 alkyl or alkenyl which may be further substituted or unsubstituted;

M+ is a positive ion as required to balance a charge;

(II)

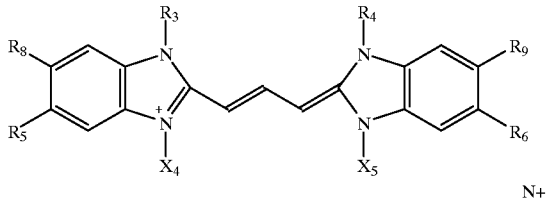

N+ where R3 and R4 may be the same or different and represent substituted or unsubstituted alkyl or alkenyl of 1 to 4 carbon atoms;

R5 and R6 may be the same or different and both represent strong electron withdrawing groups;

R8 and R9 are independently hydrogen, halogen, or a substituted or unsubstituted methyl or ethyl, or a strong electron withdrawing group;

X4 and X5 are substituted or unsubstituted C1 to C6 alkyl or alkenyl at least one of which has an acid or acid salt substituent;

N+ is a positive ion as needed to balance a charge.

2. A silver halide photographic element according to claim 1 wherein $X_1$ and $X_2$ are sulfo substituted alkyl, and at least one of $X_4$ and $X_5$ is a sulfo substituted alkyl which may be further substituted or unsubstituted.

3. A silver halide photographic element according to claim 2 wherein $X_3$ is ethyl.

4. A silver halide photographic element according to claim 3 wherein the ratio of dye I to dye II is from 9:1 to 1:2.

5. A silver halide photographic element according to claim 1 wherein $R_1$ is substituted or unsubstituted aryl.

6. A silver halide photographic element according to claim 5 wherein $R_2$ is a halogen.

7. A silver halide photographic element according to claim 1 wherein $R_5$ and $R_6$ are selected from cyano, or fluoroalkyl, substituted or unsubstituted alkoxycarbonyl, substituted or unsubstituted alkylsulfonyl, and substituted or unsubstituted sulfamoyl.

8. A silver halide photographic element according to claim 7 wherein R7 is trifluoroethyl.

9. A silver halide photographic element according to claim 7 wherein R1 and R2 in formula I are both chlorine or fluorine.

10. A silver halide photographic element according to claim 1 wherein $R_5$ and $R_6$ are both fluoroalkyl.

11. A silver halide photographic element according to claim 1 wherein $R_5$ and $R_6$ are both trifluoromethyl.

12. A silver halide photographic element according to claim 10 wherein $R_8$ and $R_9$ are selected from fluorine or chlorine.

13. A silver halide photographic element according to claim 1 wherein $X_1$, $X_2$, $X_4$ and $X_5$ are substituted or unsubstituted sulfoalkyl.

14. A silver halide photographic element according to claim 13 wherein the dye of formula I is either dye I-20 or I-12 and the dye of formula II is either dye II-2 or dye II-3 illustrated below:

I-12

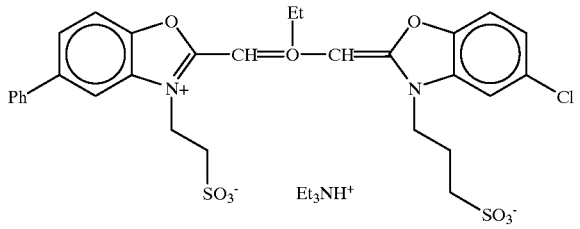

I-20

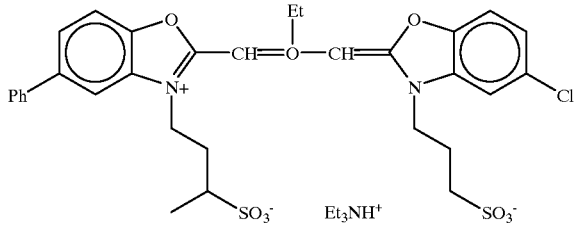

II-2

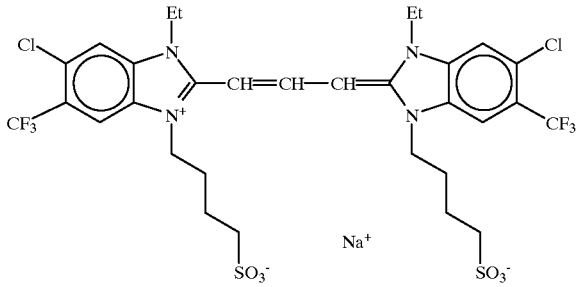

II-3

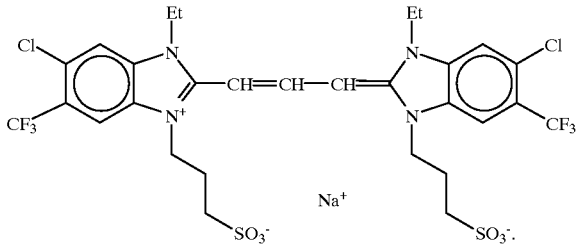

15. A silver halide photographic element according to claim 1 wherein one R1 or R2 in formula I is phenyl and R5 and R6 in formula II are both trifluoromethyl.

16. A silver halide photographic element according to claim 1 wherein the ratio of dye I to dye II is from 19:1 to 1:5.

17. A method of preparing a photographic element comprising adding to a tabular grain silver halide emulsion before chemical sensitization, at least one green spectral sensitizing dye of formula I, and at least one green spectral sensitizing dye of formula II:

(I)

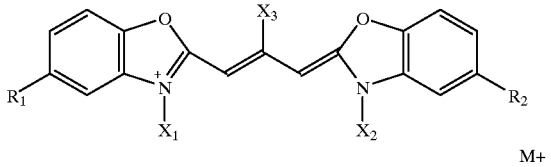

M+ wherein R1 and R2 may be the same or different and are selected from substituted or unsubstituted C1 or C2 alkyl, substituted or unsubstituted C1 or C2 alkoxy, halogen, substituted or unsubstituted amido, carbamoyl, or substituted or unsubstituted aryl, provided that R1 and R2 are not both aryl, and the benzo back rings may optionally be further substituted;

X3 is a substituted or unsubstituted C1 to C3 alkyl or alkenyl;

X1 and X2 are acid or acid salt substituted Cl to C6 alkyl or alkenyl which may be further substituted or unsubstituted;

M+ is a positive ion as required to balance a charge;

(II)

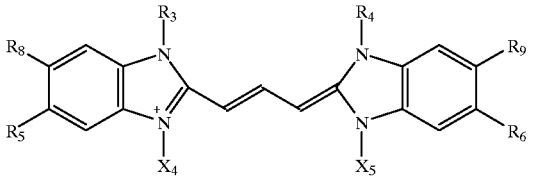

N+ where R3 and R4 may be the same or different and represent substituted or unsubstituted alkyl or alkenyl of 1 to 4 carbon atoms;

R5 and R6 may be the same or different and both represent strong electron withdrawing groups;

R8 and R9 are independently hydrogen, halogen, or a substituted or unsubstituted methyl or ethyl, or a strong electron withdrawing group;

X4 and X5 are substituted or unsubstituted C1 to C6 alkyl or alkenyl at least one of which has an acid or acid salt substituent;

N+ is a positive ion as needed to balance a charge.

18. A method according to claim 17 wherein $X_1$ and $X_2$ are sulfo substituted alkyl, and at least one of $X_4$ and $X_5$ is a sulfo substituted alkyl which may be further substituted or unsubstituted.

19. A method according to claim 18 wherein $X_3$ is ethyl.

20. A method according to claim 17 wherein $R_1$ is substituted or unsubstituted aryl.

21. A method according to claim 20 wherein $R_2$ is a halogen.

22. A method according to claim 17 wherein $R_5$ and $R_6$ are selected from cyano, or fluoroalkyl, substituted or unsubstituted alkoxycarbonyl, substituted or unsubstituted alkylsulfonyl, and substituted or unsubstituted sulfamoyl.

23. A method according to claim 17 wherein $R_5$ and $R_6$ are both fluoroalkyl.

24. A method according to claim 17 wherein $R_5$ and $R_6$ are both trifluoromethyl.

25. A method according to claim 23 wherein $R_8$ and $R_9$ are selected from fluorine or chlorine.

* * * * *